US012114811B2

(12) United States Patent
Moroyama

(10) Patent No.: US 12,114,811 B2
(45) Date of Patent: Oct. 15, 2024

(54) PAPER ROLL HOLDER

(71) Applicant: Kazuhiro Moroyama, Tokyo (JP)

(72) Inventor: Kazuhiro Moroyama, Tokyo (JP)

(73) Assignee: Kazuhiro Moroyama, Tokyo (JP)

( * ) Notice: Subject to any disclaimer, the term of this patent is extended or adjusted under 35 U.S.C. 154(b) by 90 days.

(21) Appl. No.: 17/784,347

(22) PCT Filed: Feb. 10, 2021

(86) PCT No.: PCT/JP2021/007227

§ 371 (c)(1),
(2) Date: Jun. 10, 2022

(87) PCT Pub. No.: WO2021/192805

PCT Pub. Date: Sep. 30, 2021

(65) Prior Publication Data

US 2023/0039376 A1 Feb. 9, 2023

(30) Foreign Application Priority Data

Mar. 27, 2020 (JP) ..... 2020-071941
Jun. 11, 2020 (JP) ..... 2020-116714

(51) Int. Cl.
*A47K 10/32* (2006.01)

(52) U.S. Cl.
CPC ..... *A47K 10/32* (2013.01); *A47K 2010/3253* (2013.01)

(58) Field of Classification Search
CPC ..... A47K 10/32; A47K 10/3687; A47K 2010/3253
See application file for complete search history.

(56) References Cited

U.S. PATENT DOCUMENTS 3,058,682 A * 10/1962 Mott ..... A47K 10/38 242/560.3
3,700,181 A * 10/1972 Diring ..... A47K 10/38 242/561

(Continued)

FOREIGN PATENT DOCUMENTS

JP 1979-077241 U 6/1979
JP S54077241 U1 6/1979

(Continued)

OTHER PUBLICATIONS

International Search Report issued in International Patent Application PCT/JP2021/007227 dated May 21, 2021 with English traslation.

(Continued)

*Primary Examiner* — Gene O Crawford
*Assistant Examiner* — Kelvin L Randall, Jr.
(74) *Attorney, Agent, or Firm* — Law Office of Katsuhiro Arai

(57) ABSTRACT

A hygienic paper roll holder that is gentle for elderly and toddlers and can be replaced without touching a used paper roll core and a replacement paper roll with a relatively simple configuration and easy operation with one hand. The paper roll holder comprises a U-shaped holder body, support parts for moving and supporting both sides of toilet paper, the support parts being attached to the U-shaped holder body, and a movable tray that has a stationary part for placing a replacement toilet paper and a holding part for temporarily holding a used core. By moving this movable tray up and down by hand, the used core supported by the support parts and the replacement toilet paper on the stationary part can be exchanged.

4 Claims, 6 Drawing Sheets

(56) References Cited

U.S. PATENT DOCUMENTS

| | | | | |
|---|---|---|---|---|
| 4,844,361 | A * | 7/1989 | Granger | A47K 10/3687 242/561 |
| 7,185,841 | B2 * | 3/2007 | Kaufmann | A47K 10/36 242/564.4 |
| 10,299,637 | B2 * | 5/2019 | Gottschalk | A47K 10/3687 |
| 2006/0236836 | A1 * | 10/2006 | Cassia | A47K 10/3643 83/649 |
| 2009/0266928 | A1 * | 10/2009 | Friesen | A47K 10/3687 242/559.4 |
| 2015/0216375 | A1 | 8/2015 | Okazaki | |
| 2016/0309969 | A1 * | 10/2016 | Brants | A47K 10/38 |

FOREIGN PATENT DOCUMENTS

| | | | |
|---|---|---|---|
| JP | 1979-142131 | U | 10/1979 |
| JP | S54142131 | U1 | 10/1979 |
| JP | H01129816 | A | 5/1989 |
| JP | H8-112216 | A | 5/1996 |
| JP | H08112216 | A | 5/1996 |
| JP | 3055169 | U | 1/1999 |
| JP | H11-169315 | A | 6/1999 |
| JP | 2002112921 | A | 4/2002 |
| JP | 2004-313676 | A | 11/2004 |
| JP | 2006-150004 | A | 6/2006 |
| JP | 2014033922 | A | 7/2017 |
| JP | 6488444 | B1 | 3/2019 |
| WO | 2014-024809 | A1 | 2/2014 |

OTHER PUBLICATIONS

International Search Report (ISR) mailed May 11, 2021, issued for International application No. PCT/JP2021/007227. (3 pages).

* cited by examiner

PAPER ROLL HOLDER

CROSS-REFERENCE OF RELATED APPLICATIONS

This application in the U.S. National Phase under 35 U.S.C. § 371 of International Patent Application No. PCT/JP2021/007227, filed on Feb. 10, 2021, which in turn claims the benefit of Japanese Application No. 2020-071941, filed on Mar. 27, 2020, and Japanese Application No. 2020-116714, filed on Jun. 11, 2020, the entire disclosures of which Applications are incorporated by reference herein.

TECHNICAL FIELD

The present invention relates to a paper roll holder that allows easy replacement of a used paper roll.

BACKGROUND OF THE INVENTION

In the case of conventional toilet paper, it is common to wind a strip of paper around a cylindrical core in a roll shape. In order to hold the cylindrical core, a shaft passing through inside of the cylindrical core is attached to a holder, and the holder attached to wall of a toilet is used. However, in the case of a conventional toilet paper holder having this structure, it takes time and efforts to replace used toilet paper.

Therefore, Japanese Patent: 6488444 discloses a U-shaped holder having a shaft that holds the toilet paper wherein the shaft is cantilevered, and the fixed main body is rotated to easily replace the toilet paper.

Japanese Patent Publication: 2002-112921 discloses a U-shaped holder having a shaft that holds only both ends of the cylindrical core of the paper in a U-shaped holder, and the paper roll is lifted by hand from the lower side of the shaft. The shaft has a spring structure. When the shaft reaches inside the core, the spring structure returns to a steady state to support the paper roll.

Japanese Patent Publication: H01-129816 discloses a U-shaped holder having a shaft that holds only both ends of the cylindrical core of the paper in a U-shaped holder. A place for storing replacement paper roll is provided at an upper portion of the holder. The replacement paper roll is arranged to be lowered by a lever operation, and the replacement paper roll is held by this shaft.

DISCLOSURE OF THE INVENTION

Problem to be Solved by the Invention

However, according to Japanese Patent: 6488444, although it is easier to replace the toilet paper than a conventional toilet paper holder, it is necessary to rotate one side of a holder body after lifting a cover including a cutter on the upper surface of the toilet paper, so that the operation must be done with both hands. Therefore, the posture is strict to change the toilet paper while using the toilet.

Further, according to Japanese Patent Publication: 2002-112921, the paper roll can be easily replaced with one hand, but since the paper roll must be held directly by a hand, in the case of toilet paper, the replacement of the toilet paper while using the toilet is not hygienic, because you need to touch the toilet paper and the toilet paper storage case with your hands.

Further, according to Japanese Patent Publication: H01-129816, the paper roll can be replaced by one-handed operation without touching the paper roll. However, the structure is complicated, and the number of parts is not small.

The present invention differs in that a mechanism for replacing the paper roll with a simple operation of only one hand without touching the paper roll is realized with a relatively simple structure. As a result, in contrast to Japanese Patent: 6488444 and Japanese Patent Publication: 2002-112921, in the case of toilet paper, the posture is not unreasonable even when replacing the toilet paper while the toilet is in use, and the hygiene is also excellent.

As a result, even elderly people and infants can easily change the toilet paper. In the case of kitchen paper, there is an effect (that) the paper roll can be changed when only one hand can be used.

As a result, in contrast to Japanese Patent Publication: H01-129816, a paper roll holder having capability for replacing the paper roll by a simple operation with only one hand without touching the paper roll is realized with a relatively simple structure.

The problems to be solved by the present invention is to provide a paper holder that does not require a power source such as an electric-motor or a particularly complicated configuration, has a relatively simple structure, is hygienic, and can replace a paper roll without touching the paper roll with a simple operation.

Means to Solve Problems

A paper roll holder of the present invention according to claim 1 comprises a U-shaped holder body for covering both ends of a paper roll, the U-shaped holder body including support parts for supporting a core of the paper roll from both sides by reacting to movement of the paper roll, and a movable body attached to the U-shaped holder body so as to be slidably up and down, the movable body integrally including a stationary part for stationing a replacement paper roll and a holding part for temporarily holding the core of a used paper roll, the core being removed from the support parts, wherein the replacement paper roll stationed on the stationary part pushes up the core of the used paper roll supported by the support parts when an operator pulls the movable body upward, and the replacement paper roll is supported by the support parts, the holding part being structured at a position where the core of the used paper roll removed from the support parts moves by its own weight, and wherein, when the operator operates the movable body downward, the core of the used paper roll moves from the holding part to the stationary part due to its own weight so that the core of the used paper roll supported by the support parts can be replaced by the replacement paper roll stationed on the station part without touching the core of the used paper roll supported by the support parts and the replacement paper roll stationed on the stationary part by a hand of the operator.

The paper roll holder of the present invention according to claim 2 is described as followings: The paper roll holder of claim 1 further comprises a structure for guiding the core of the used paper roll to the holding part, the structure being arranged to restrict a space formed between a paper cutter in front of the holder body and the replacement paper roll, not to pass the core of the used paper roll through the space and to restrict movement of the core of the used paper roll toward a front side of the holder body when the replacement paper roll pushes up the core of the used paper roll by removing a rotation axis part of the paper cutter attached to an upper portion of the holder body when operating the movable body.

The paper roll holder of the present invention according to claim 3 is described as followings: The paper roll holder of claim 1, further comprises a paper cutter stopper for positioning the paper cutter on the paper roll by restricting rotation movement of the paper cutter in a rotation direction after removing a rotation axis part of the paper cutter from the holder body and moving therefrom.

The paper roll holder of the present invention according to claim 4 is described as followings: The paper roll holder of claim 1, further comprises a slope for easily positioning the paper cutter on the paper roll by adjusting movement in a rotation direction of the paper cutter when removing a rotation axis part of the paper cutter from the holder body and moving therefrom.

Effects of the Invention

According to the paper roll holder of the present invention of claim 1, it becomes possible to replace the paper roll with a simple operation of one hand without touching the paper roll at all. In the case of toilet paper, the posture of the operator is not unreasonable even when replacing the toilet paper while the toilet is in use, the hygiene of the toilet paper and the toilet paper storage case can be maintained.

According to the paper roll holder of the present invention of claim 2, the core of the used paper roll removed from the support parts can be prevented from falling off to the front side of the holder body, and the core of the used paper roll can be guided to the holding part by moving and separating the rotation part of the paper cutter on the holder body side from the holder body to secure a space on the back side of the holder body.

According to the paper roll holder of the present invention of claim 3, in the process of separating and moving the rotation part of the paper cutter from the holder body, the core of the used paper roll is removed from the support parts, the movement of the paper cutter in the rotation direction is not restricted, and the paper cutter which is no longer restricted in its movement in the rotating direction rotates. This prevents the paper cutter from getting stuck between the paper roll that has been replaced and supported to the support parts and the holder body, and after the paper cutter has been separated and moved, the paper cutter is set in place on the paper roll.

According to the paper roll holder of the present invention of claim 4, since an inclination angle can be added to the inclination angle of the paper cutter in the rotation direction determined by the paper cutter stopper in the process of separating and moving the rotation portion of the paper cutter from the holder body, it becomes easy to place the paper cutter on the paper roll after the separation and movement of the paper cutter is completed.

BEST MODE FOR CARRING OUT THE INVENTION

An Embodiment

Figure 1:
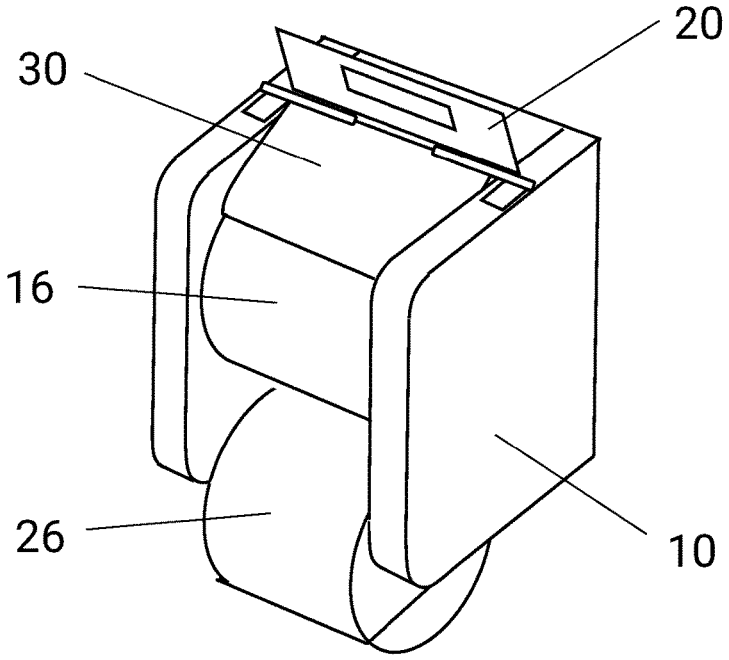
FIG. 1 is a perspective view of the paper roll holder illustrated in an embodiment of the invention.

An embodiment of the present invention being applied to toilet paper will be described with reference to the drawings. A paper roll holder illustrated in FIG. 1 is an embodiment of the present invention which includes a movable tray 20 and a movable paper cutter 30 in a holder body 10 being installed onto a wall or the like. FIG. 1 illustrates a state in which an unused toilet paper 16 and a replacement toilet paper 26 are installed into a paper roll holder.

Holder Body 10

Figure 2:
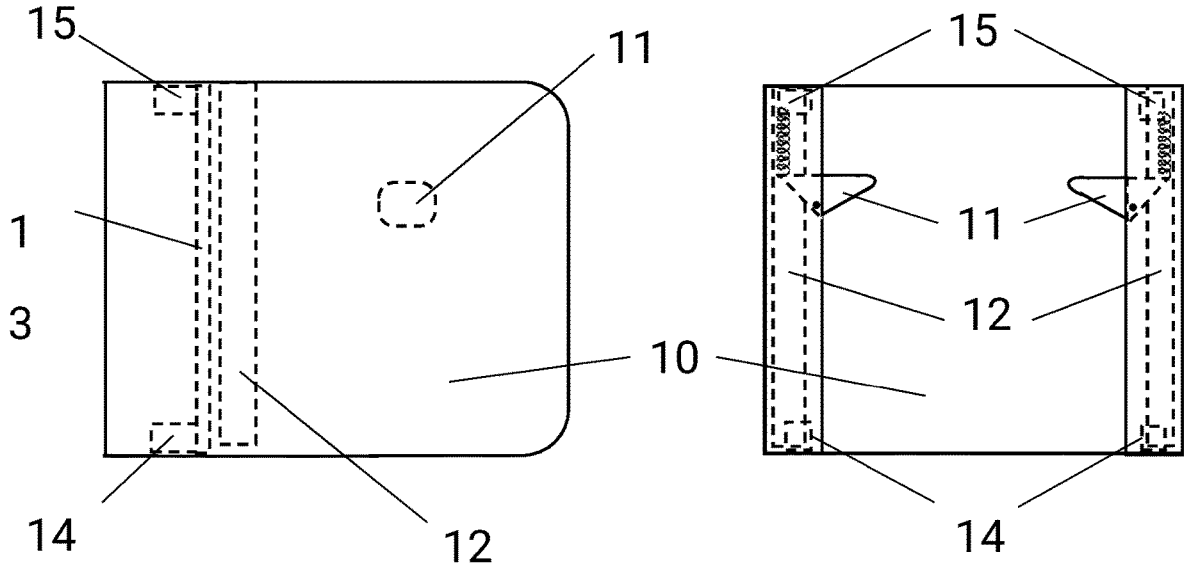
FIG. 2 is a side view and the front view of the holder body of the paper roll holder illustrated in an embodiment of the invention.

As illustrated in FIG. 2, the holder body 10 includes support parts 11 for supporting a toilet paper, paper cutter support pillar guides 12, upper tray stoppers 15 and lower tray stoppers 14 attached an upper portion and a lower portion of a movable tray guide 13 for guiding the movable tray 20 on both sides of the U-shaped holder. The support parts 11 arranged to move when the toilet paper is inserted from the lower side and return to steady state by spring force when they reach to the inside of the core.

Movable Tray 20

Figure 3:
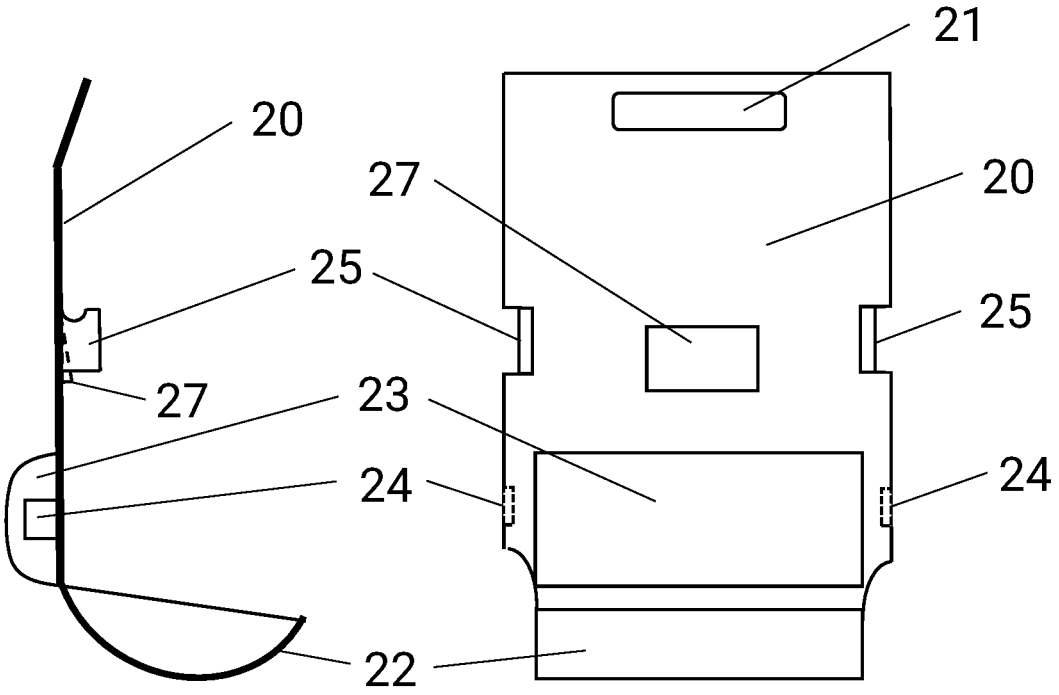
FIG. 3 is a side view and the front view of the movable tray of the paper roll holder illustrated in an embodiment of the invention.

As illustrated in FIG. 3, the movable tray 20 includes an operation part 21, a stationary part 22 and a holding part 23. The operation part 21 is a handle for an operator to manually operate the paper roll holder of the present invention. The stationary part 22 is a place where unused replacement toilet paper 26 is placed, and the holding part 23 serves as a passage through which a used core 17 is replaced before moving to the stationary part 22.

Tray movement amount adjustment parts 24 determine the movable range of the movable tray 20 by using the lower tray stoppers 14 and the upper tray stoppers 15.

It is necessary to adjust the shape and installation position of the tray movement amount adjustment parts 24 and paper cutter hooks 25 in order to establish [movements of the movable tray 20 and the movable paper cutter 30] which will be described later.

Movable Paper Cutter 30

Figure 4:
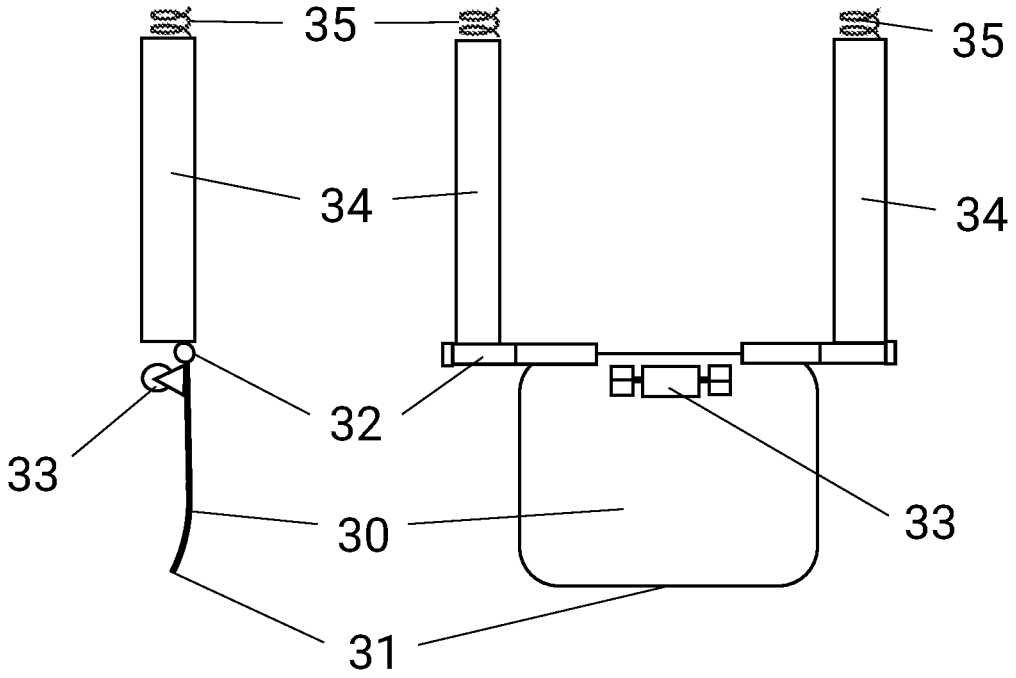
FIG. 4 is a side view and a rear view of a movable paper cutter of the paper roll holder illustrated in an embodiment example of the invention.

As illustrated in FIG. 4, the movable paper cutter 30 includes a cutter part 31 for cutting paper at the first end and the paper cutter rotating part 32 at the second end. Paper cutter support pillars 34 are attached to a paper cutter rotating part 32 being rotatable, and a paper cutter stopper 33 for restricting the movement of the movable paper cutter 30 in the rotation direction is attached near the paper cutter rotating part 32.

Figure 5:
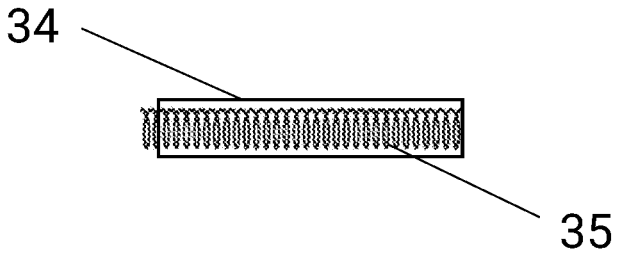
FIG. 5 is an internal structure view of paper cutter support pillars of a paper roll holder illustrated in an embodiment of the invention.

The paper cutter support pillars 34 illustrated in FIG. 5 includes springs 35 inside thereof. The first end of the springs 35 attaches to the paper cutter rotating part 32 side inside the paper cutter support pillars 34, and a second end portion attaches to the lower side of the paper cutter support pillar guides 12. As a result, the movable paper cutter 30 is pulled down while the paper cutter rotating part 32 is pushed up, and the operation is stabilized by providing a downward pulling force to the movable paper cutter 30. An example of applying a downward pulling force to the movable paper cutter 30 by the springs 35 has been disclosed. However, other methods may be used as long as the downward pulling force can be applied to the movable paper cutter 30.

Movements of the Movable Tray 20 and the Movable Paper Cutter 30

Figure 6:
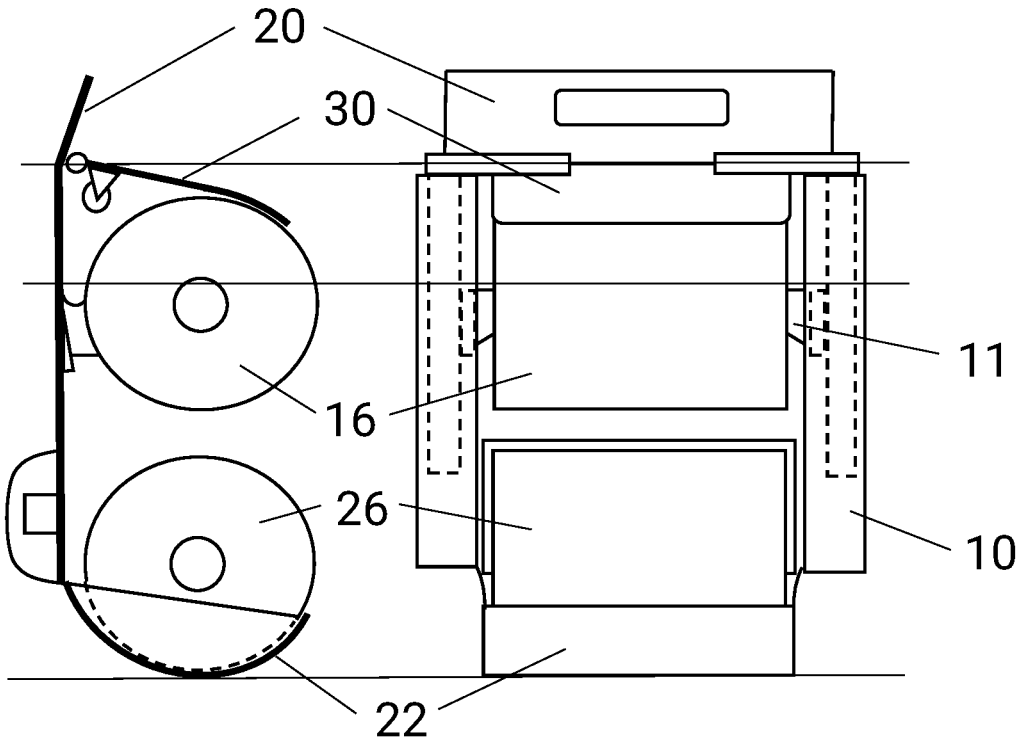
FIG. 6 is a side view of a movable tray and a front view of a paper roll holder at the time of operation of the paper roll holder illustrated in an embodiment of the invention.

FIG. 6 illustrates a state in which an unused toilet paper 16 is held by the support parts 11 and the replacement toilet paper 26 is placed on the stationary part 22.

Figure 7:
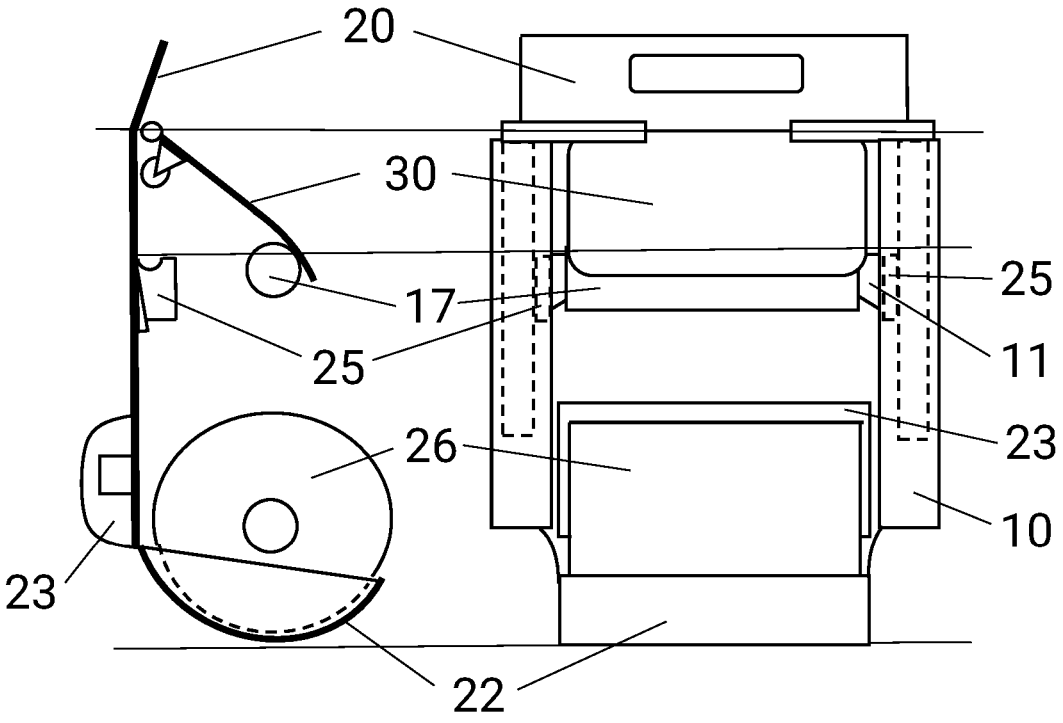
FIG. 7 is a side view of a movable tray and a front view of a paper roll holder at the time of operation of the paper roll holder illustrated in an embodiment of the invention.

FIG. 7 illustrates a state in which the unused toilet paper 16 held by the support parts 11 illustrated in FIG. 6 has been used and become the used core 17.

Figure 8:
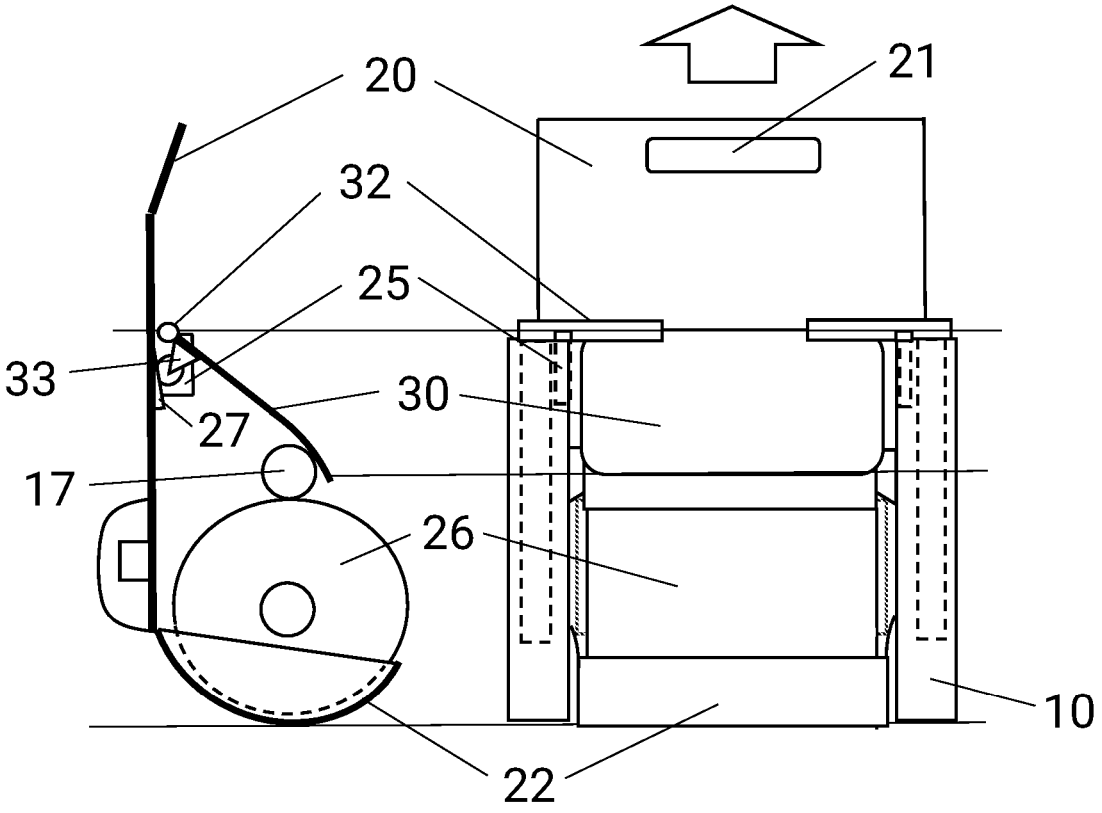
FIG. 8 is a side view of a movable tray and a front view of a paper roll holder at the time of operation of the paper roll holder illustrated in an embodiment of the invention.

FIG. 8 illustrates a state in which the replacement toilet paper 26 placed in the stationary part 22 touches to the used core 17 by operating the operation part 21 upward by an operator.

At this time, the paper cutter stopper 33 is pushed toward the front side of the holder body 10 by a slope 27, and the paper cutter hooks 25 engage with the paper cutter rotating part 32 with the inclination of the movable paper cutter 30 adjusted in the rotation direction.

Figure 10:
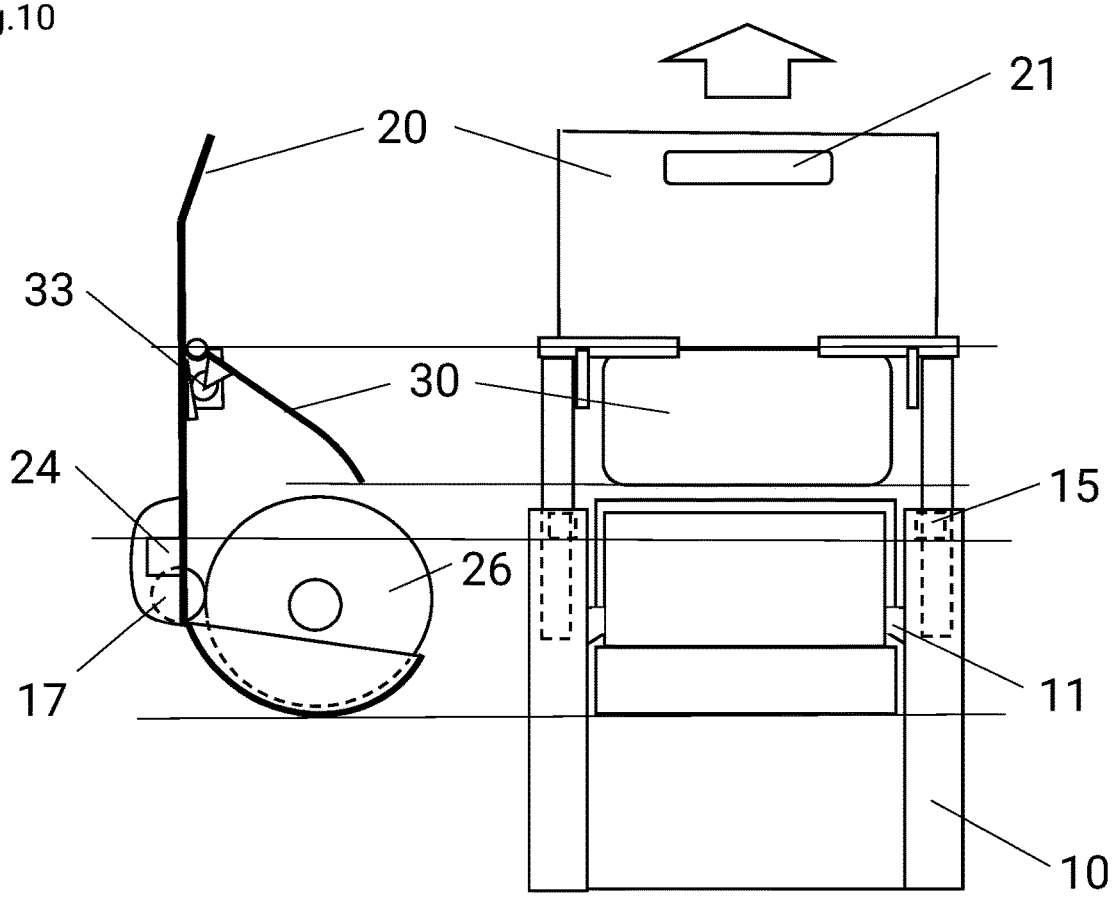
FIG. 10 is a side view of a movable tray and a front view of a paper roll holder at the time of operation of the paper roll holder illustrated in an embodiment of the invention.

As a result, the positional relationship between the replacement toilet paper 26 and the movable paper cutter 30 is maintained until the replacement toilet paper 26 is supported by the support parts 11 as illustrated in FIG. 10. After that, in the process of operating the operation part 21 downward to reach the status illustrated in FIG. 11, the movable paper cutter 30 is easily placed on the replacement toilet paper 26. If the movable paper cutter 30 can be placed on the replacement toilet paper 26 with only the paper cutter stopper 33, the slope 27 does not have to be attached.

Figure 9:
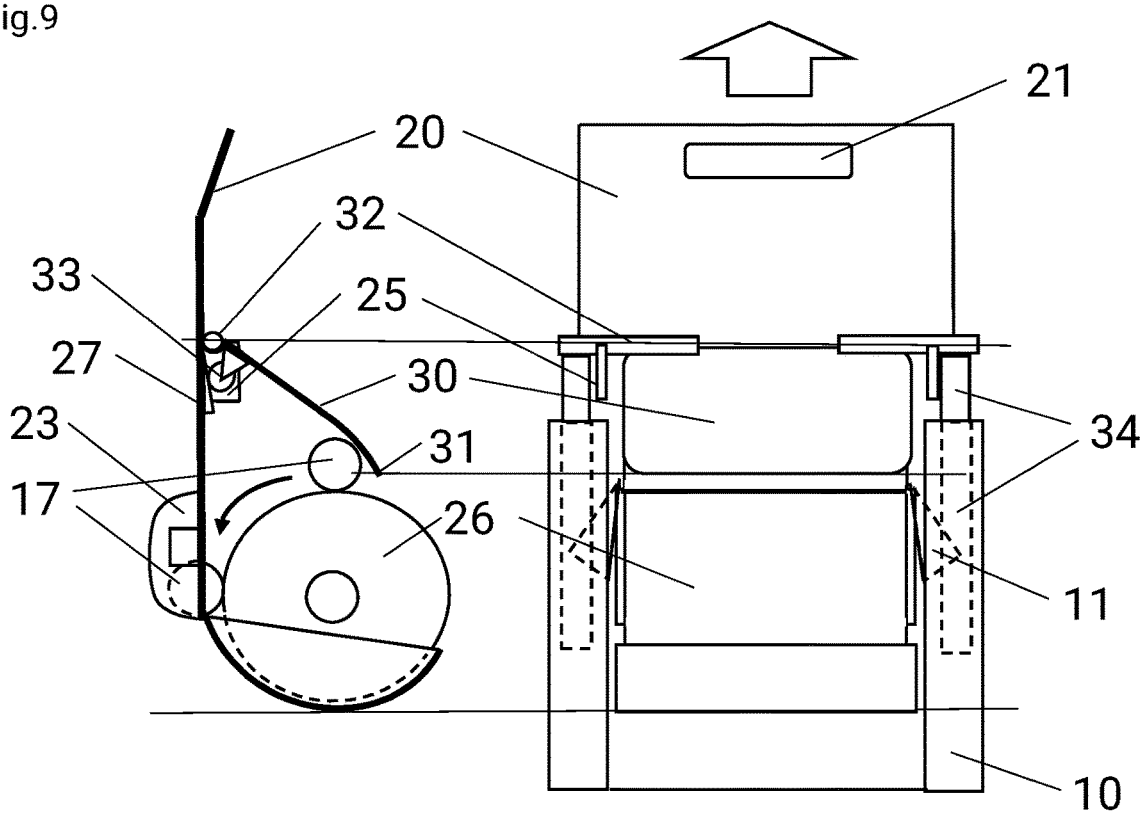
FIG. 9 is a side view of a movable tray and a front view of a paper roll holder at the time of operation of the paper roll holder illustrated in an embodiment of the invention.

FIG. 9 illustrates a situation, where the replacement toilet paper 26 placed on the stationary part 22 pushes up the used core 17 by the operator operating the operation part 21 further upward, and the used core 17 is removed from the support parts 11. At this time, the used core 17 is not supported, however, the movement of the used core 17 to the front side of the holder body 10 is restricted by the movable paper cutter 30 being pushed up, so that the used core 17 is guided into the holding part 23 via the surface of the replacement toilet paper 26. Since the paper cutter rotating part 32 is pushed up by the paper cutter hooks 25, there is no gap between the cutter part 31 and the replacement toilet paper 26 through which the used core 17 can pass through even if the used core 17 is freed, therefore, it is possible to restrict the movement of the removed the used core 17 to the front side of the holder body 10.

When the used core 17 is removed from the support parts 11, and the movable paper cutter 30 with no restrictions is rotated to the back side of the holder body 10, the movable paper cutter 30 is inserted between the replacement toilet paper 26 and the holder body 10, so that the movable paper cutter 30 will be unusable when the movable tray 20 is operated downward and returned to the original position which will be described later using FIG. 11. To prevent this, the paper cutter stopper 33 restricts the movement of the movable paper cutter 30 in the rotation direction.

FIG. 10 illustrates a state in which the replacement toilet paper 26 is supported by the support parts 11 by the operations by the operator to push the operation part 21 further upward. At this time, since the tray movement amount adjusting parts 24 meet the upper tray stoppers 15, the upward movement of the movable tray 20 is restricted.

Figure 11:
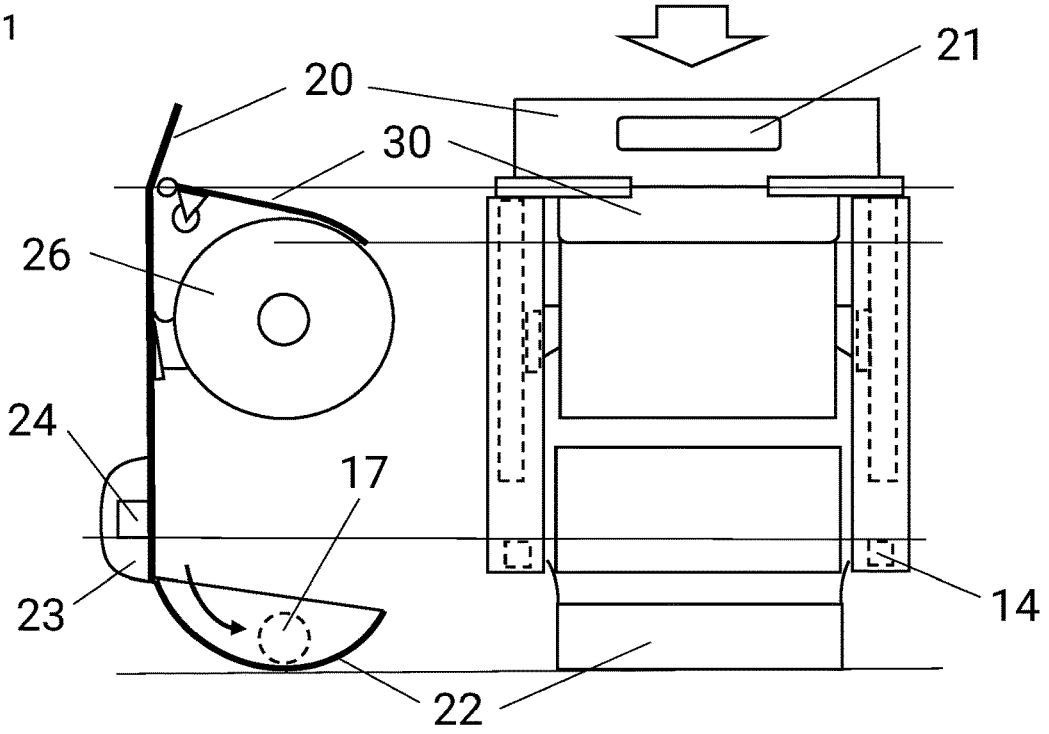
FIG. 11*s* a side view of a movable tray and a front view of a paper roll holder at the time of operation of the paper roll holder illustrated in an embodiment of the invention.

FIG. 11 illustrates a state in which the tray movement amount adjustment parts 24 meet the lower tray stoppers 14 when the operator operates the operation part 21 downward, the movable tray 20 reaches to the lowermost position and returns to the original position.

In the process of this operation, the used core 17 stayed in the holding part 23 by the replacement toilet paper 26, moves to the stationary part 22 because the restraint is removed as the movable tray 20 descends.

A Modification Example

In this embodiment, the movable tray 20 can be moved up and down by manually operating the operation part 21. However, other methods may be used as long as the movable tray 20 can be moved up and down.

Figure 12:
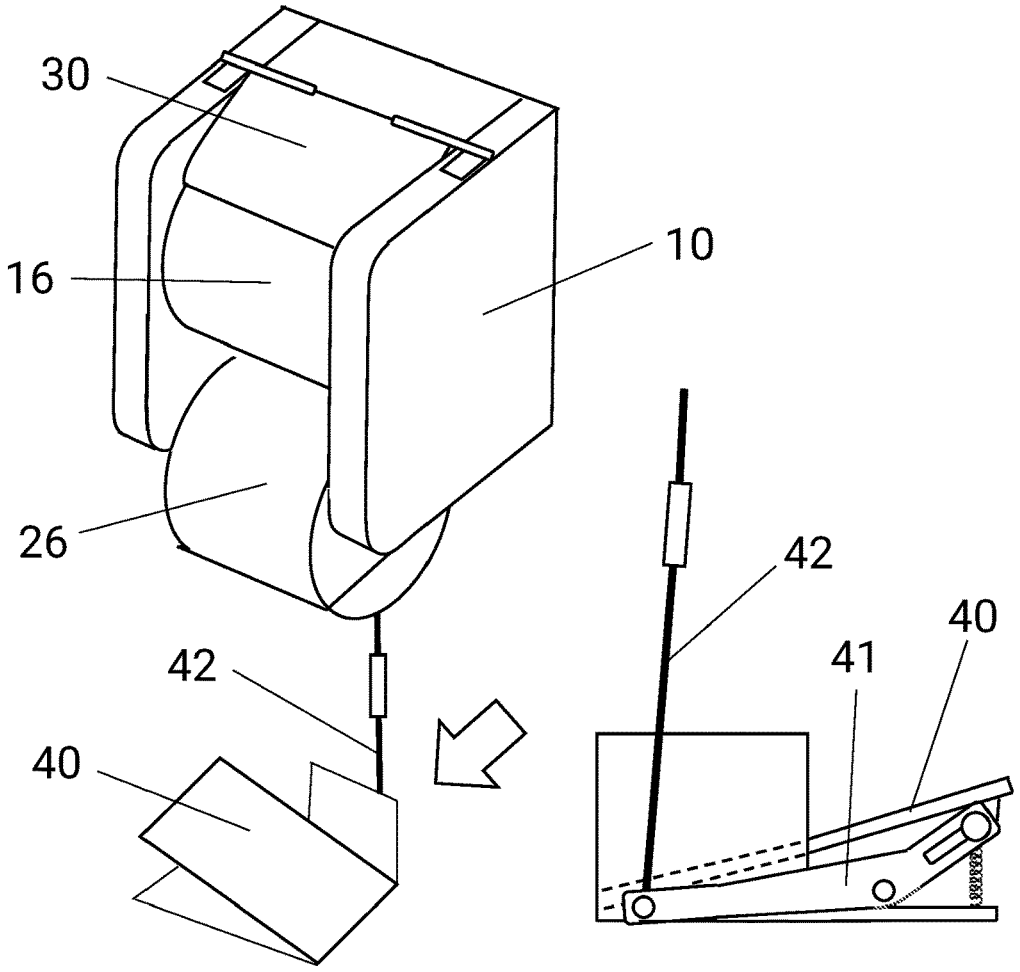
FIG. 12 is a perspective view of the paper roll holder illustrated in another embodiment of the invention.

FIG. 12 illustrates anther embodiment in which the movable tray 20 can be moved up and down with a foot. When a pedal 40 is pushed with the foot, the movable tray 20 connected to a rod 42 is raised via a link 41, and when the foot is released from the pedal 40, the movable tray 20 is lowered.

EXPLANATION OF PARTS NUMBERS

10 Holder body
11 Support parts
12 Paper cutter support pillar guides
13 Movable tray guide
14 Lower tray stoppers
15 Upper tray stoppers
16 Unused toilet paper
17 Used core
20 Movable tray
21 Operation part
22 Stationary part
23 Holding part
24 Tray movement amount adjustment parts
25 Paper cutter hooks
26 Replacement toilet paper
27 Slope
30 Movable paper cutter
31 Cutter part
32 Paper cutter rotating part
33 Paper cutter stopper
34 Paper cutter support pillars
35 Springs
40 Pedal
41 Link
42 Rod

The invention claimed is:

1. A paper roll holder comprising:

a U-shaped holder body for covering both ends of a paper roll, the U-shaped holder body including support parts for supporting a core of the paper roll from both sides by reacting to movement of the paper roll; and a movable body attached to the U-shaped holder body so as to be slidably up and down, the movable body integrally including a stationary part for stationing a replacement paper roll and a holding part for temporarily holding the core of the paper roll after the paper roll has been used and removed from the support parts, due to a user manually pulling the movable body in an upwards direction, thereby, beginning a refill process using the replacement paper roll, wherein the replacement paper roll stationed on the stationary part pushes up the core of the used paper roll supported by the support parts when the user pulls the movable body upward, causing the core of the used paper roll to disengage from the support parts, and the replacement paper roll to engage with the support parts to become supported by the support parts, the holding part being structured at a position to receive the core of the used paper roll, by way of the core's own weight, that has been removed from the support parts, and wherein, when the user operates the movable body downward, the core of the used paper roll moves from the holding part to the stationary part due to its own weight, resulting in the core of the used paper roll being replaced by the replacement paper roll, stationed as a new roll on the support parts, without a user having to touch the core of the used paper roll and the replacement paper roll by hand.

2. The paper roll holder of claim 1 further comprising:

a structure for guiding the core of the used paper roll to the holding part, the structure being arranged to restrict a space formed between a paper cutter in front of the holder body and the replacement paper roll, not to pass the core of the used paper roll through the space and to restrict movement of the core of the used paper roll toward a front side of the holder body when the replacement paper roll pushes up the core of the used paper roll by removing a rotation axis part of the paper cutter attached to an upper portion of the holder body when operating the movable body.

3. The paper roll holder of claim 2, further comprising:

a paper cutter stopper for positioning the paper cutter on the paper roll by restricting rotation movement of the paper cutter in a rotation direction after removing a rotation axis part of the paper cutter from the holder body and moving therefrom.

4. The paper roll holder of claim 2, further comprising:

a slope for easily positioning the paper cutter on the paper roll by adjusting movement in a rotation direction of the paper cutter when removing a rotation axis part of the paper cutter from the holder body and moving therefrom.

* * * * *